United States Patent [19]

Katakura et al.

[11] 4,140,894

[45] Feb. 20, 1979

[54] METHOD OF USING A TEMPERATURE CONTROLLER FOR A FIXING DEVICE OF A COPYING MACHINE

[75] Inventors: Hiroshi Katakura, Fuchu; Hidehiko Kurotsu, Hino both of Japan

[73] Assignee: Konishiroku Photo Industry Co., Ltd., Tokyo, Japan

[21] Appl. No.: 851,214

[22] Filed: Nov. 14, 1977

[30] Foreign Application Priority Data

Nov. 16, 1976 [JP] Japan ..... 51-136926

[51] Int. Cl.[2] ..... G03G 15/20

[52] U.S. Cl. ..... 219/358; 219/216; 219/388; 355/3 FU

[58] Field of Search ..... 219/216, 388 C, 358, 219/469, 470, 471; 355/3 FU, 14; 432/59, 237

[56] References Cited

U.S. PATENT DOCUMENTS

| | | | |
|---|---|---|---|
| 3,187,162 | 6/1965 | Hojo et al. | 355/3 FU |
| 3,398,259 | 8/1968 | Tregay et al. | 355/3 FU |
| 3,833,794 | 9/1974 | Moriyama | 219/358 |

*Primary Examiner*—J. V. Truhe
*Assistant Examiner*—Bernard Roskoski
*Attorney, Agent, or Firm*—Bierman & Bierman

[57] ABSTRACT

A method of using a temperature controller for a fixing device of a copying machine in which the lamp heaters are subject to on-off control by a temperature detector to maintain the temperature at a constant level after the start of the copying cycle but before the paper reaches the fixing device. At some predetermined time prior to the paper reaching the fixing device, the temperature controller is deactivated and full power applied to the lamps until the paper leaves the fixing device at which time the temperature is again controlled by the temperature detector.

2 Claims, 2 Drawing Figures

METHOD OF USING A TEMPERATURE CONTROLLER FOR A FIXING DEVICE OF A COPYING MACHINE

This invention relates to a method of using a temperature controller for a fixing device of a copying machine.

The use of lamp heaters in a fixing device of a copying machine provides the advantages of a short temperature rise and easy handling. However, in order to perform the perfect fixing, the lamp must be lit during the fixing operation whereby temperature control becomes difficult and causes such problems as over-heat of the fixing device, scorch and burning of paper, and the like.

The present invention is therefore directed a method of using a temperature controller for a fixing device of a copying machine which satisfies the requirement that the lamps are lit during the fixing operation and yet enables to effect temperature control so as to prevent the abovementioned problems such as over-heat of the fixing device, scorch and burning of the paper, etc.

The device of the present invention is characterized by a construction comprising a lower plate having good heat absorption- and emission-properties and a small heat capacity which is positioned below the passage of paper so as to oppose to lamp heaters, a temperature detecting means provided on the lower plate, and a control mechanism controlling the feed of a current to the lamp heaters in accordance with the copying operation.

Figure 1:
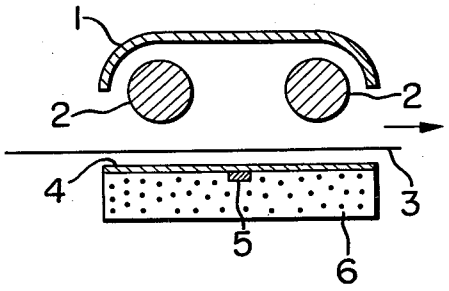
Figure 2:
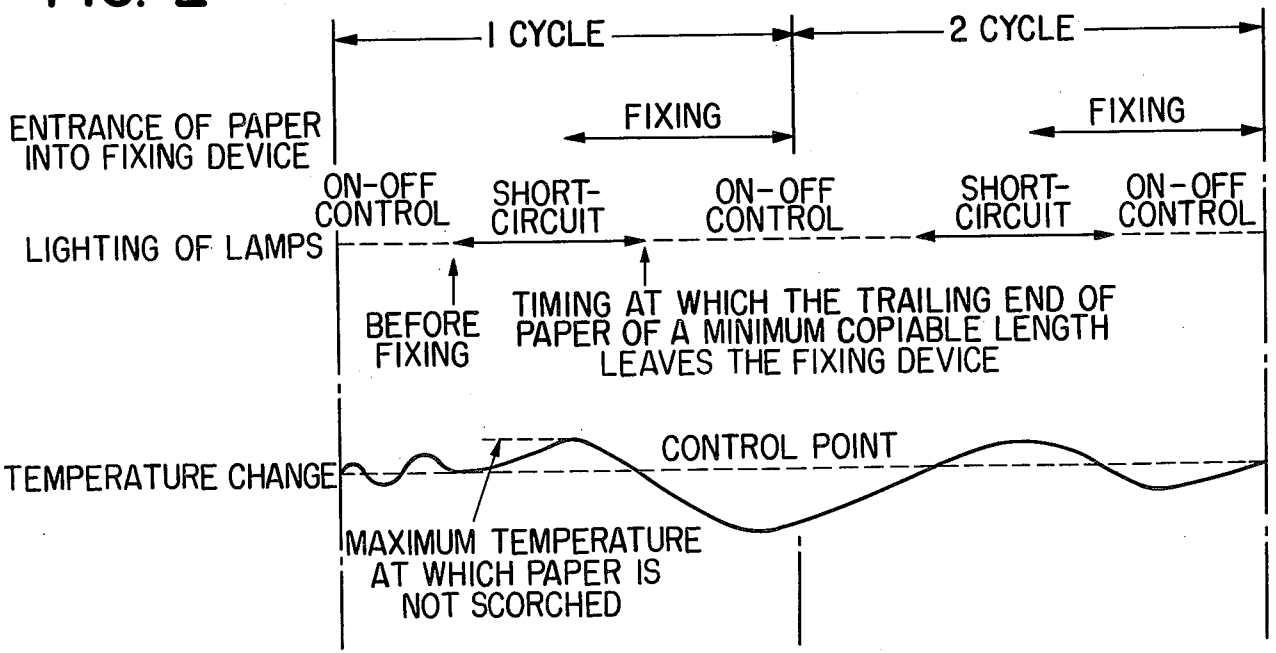

The invention will now be described in detail in respect of a preferred embodiment with reference to accompanying drawings in which:

FIG. 1 is a schematic view showing the device in accordance with the present invention, and FIG. 2 is a diagram showing the method of using the device of the present invention.

In FIG. 1, reference numeral 1 designates a heat reflecting plate of fixing device and numeral 2 designates lamp heaters positioned oppositely to the heat reflecting plate 1. The lamp heaters 2 are alternatively controlled under the two conditions by, for example, an output signal of microswitches related to cams (not shown) provided in a machine under the first condition, the lamp heaters 2 are subjected to ON-OFF control according to act of the temperature detecting means 5. And second condition, it is compulsively continuously actuated without being effected to the temperature detecting means, thereafter it is resumed to the ON-OFF control as described above. Paper 3 is caused to pass about 5 to 6 mm below the lamp heaters 2 to be fixed, by a proper means, for example such a gripper (not shown) which is movably provided in a copying machine. In the conventional fixing device, when the paper 3 reaches the inside of the fixing device, it absorbs the heat and lowers a required fixing temperature. If heating by the lamp heaters is enhanced in advance in order to make up for the heat absorption, there frequently takes place such a problem as scorching or burning of the paper in the latter half of a copying cycle.

In order to solve the abovementioned problem, the temperature controller in accordance with the present invention includes a lower plate 4 made of a thin metal having a small heat capacity and a surface to ensure good heat absorption and emission and provided below the passage of the paper 3. Preferably a surface of the lower plate 4 is formed with corrugation and colored in black. A temperature detecting means 5 is provided on the lower plate 4 and a heat insulating material 6 encompasses the lower plate 4 and the temperature detecting means 5.

In the temperature controller having the abovementioned construction of the present invention, when the paper 3 first comes into the fixing device, the temperature drop of the fixing device due to the paper is compensated by the heat from the lower plate 4 that has been in advance heated by the lamp heaters 2, and thereafter, the lamp heaters 2 are subjected to ON-OFF control by an ordinary temperature controlling mechanism (not shown) actuated by the output of the temperature detecting means 5, thereby perfectly eliminating the problem with the conventional device.

In a preferred method of using the temperature controller in the present invention, the lamp heaters 2 are subjected to ON-OFF control in an ordinary manner so as to always maintain the temperature at a constant level by means of the temperature detecting means 5 immediately after the start of a copying cycle, that is, before the paper reaches the fixing device, as shown in FIG. 2. Next, the ON-OFF control is stopped and the lamp heaters 2 are continuously fed with a current without being effected to the temperature detecting means 5 during the time interval starting from a predetermined time before the start of fixing after the paper has entered into the fixing device till the tail end of the paper of a minimum length leaves the fixing device, and the ON-OFF control is thereafter resumed. In the specification, the word of "the paper of a minimum length" means, for instance, a paper of B5 size against the A4 or B4 sizes paper. As a result, the temperature on the paper 3 attains the maximum level at which the paper is not scorched at the start of fixing, and thereafter gradually lowers to complete the fixing. Incidentally, the abovementioned predetermined time is properly determined in dependence upon the internal construction of the fixing device and quality of the paper used.

It is generally in the later half of one copying cycle that the paper enters into the fixing device. When the output of the heaters is yet small, therefore, it is necessary to utilize a heat quantity supplied from the heaters in the former half of the copying cycle when the paper does not yet enter into the fixing device. Consequently, it is too late to supply the heat after the paper has entered into the fixing device and the device as a whole starts cooling. Furthermore, the lamp heaters 2 do not immediately cause heat radiation even though they are supplied with the current. For these reasons, it is necessary to stop the ON-OFF control of an ordinary temperature for a certain period during one copying cycle and compulsively continuously feed the current to the lamp heaters. If the period of this compulsive feed of the current is too long, however, the fixing device tends to cause over-heat during the continuous fixing of paper of a relatively small size. Hence, it is necessary to stop the compulsive feed of the current and resume the ordinary ON-OFF control from the time at which the paper of a minimum copiable length is about to leave the fixing device. In other words, if the paper has a short length and rapidly passes through the fixing device, the temperature of the lower plate 4 is immediately elevated since it is directly irradiated by the lamp hearters. In such a case, the ON-OFF control must be immediately resumed. If the timing of the start of the compulsive feed of the current is too early, on the other hand, the temperature of the lower plate 4 is excessively elevated.

Consequently, when the ordinary ON-OFF control is resumed in the later half of the copying cycle, the temperature of the lower plate 4 is still higher than the control point of temperature and thus the lamp heaters 2 do not work because the temperature detecting means 5 will not give a signal to operate the heaters 2. If the paper is present inside the fixing device in this instance, therefore, the subsequent portion of the paper is unfixed. Accordingly, the starting time of the compulsive feed of the current must be set to a proper timing after the start of one copying cycle but before the entrance of the paper into the fixing device.

The method in accordance with the present invention perfectly solves all the abovementioned problems, enables to perform the satisfactory fixing and thus brings about great advantage.

What we claim is:

1. A method of using a temperature controller for a fixing device of a copying machine which comprises: effecting ON-OFF control of feed of a current to lamp heaters immediately after the start of a copying cycle by means of the output of a temperature detecting means provided on a lower plate having good heat absorption- and emission-properties and small heat capacity, and positioned below the passage of paper so as to oppose said lamp heaters; stopping the ON-OFF control and permitting said lamp heaters to be continuously fed with the current during the interval starting from a predetermined time prior to the initiation of fixing of the paper till the tail end of the paper of a minimum length leaves the fixing device; and thereafter resuming the ON-OFF control.

2. A method of using a temperature controller as set forth in claim 1 wherein said lower plate has a corrugated surface to provide good heat absorption- and emission-properties.

* * * * *